US005422708A

United States Patent [19]

Morris et al.

[11] Patent Number: 5,422,708

[45] Date of Patent: Jun. 6, 1995

[54] APPARATUS AND METHOD FOR METERING TONER IN LASER PRINTERS

[76] Inventors: Troy Morris; Bud Randolph, both of 5635 S. Waterbury Way, Ste. C-101, Salt Lake City, Utah 84121

[21] Appl. No.: 172,860

[22] Filed: Dec. 23, 1993

[51] Int. Cl.[6] ..... G03G 13/09

[52] U.S. Cl. ..... 355/246; 430/122; 118/657; 355/251

[58] Field of Search ..... 355/251, 253, 259, 245, 355/246; 118/657, 658; 430/106.6, 107–111, 122

[56] References Cited

U.S. PATENT DOCUMENTS

| | | | |
|---|---|---|---|
| 3,901,188 | 8/1975 | Eberlein . | |
| 4,350,432 | 9/1982 | Kondoh | 118/658 X |
| 4,373,468 | 2/1983 | Suda et al. . | |
| 4,373,798 | 2/1983 | Tsukada et al. | 118/658 X |
| 4,430,409 | 2/1984 | Matsumoto et al. | 430/106.6 |
| 4,478,505 | 10/1984 | Tashiro . | |
| 4,492,321 | 1/1985 | Zoltner . | |
| 4,518,673 | 5/1985 | Noguchi et al. | 430/108 |
| 4,597,661 | 7/1986 | Yamashita . | |
| 4,640,880 | 2/1987 | Kawanishi et al. | 430/106.6 |
| 4,963,930 | 10/1990 | Yoshimaru et al. | 355/215 |
| 4,984,024 | 1/1991 | Ohkaji et al. . | |
| 5,051,778 | 9/1991 | Watanabe et al. | 355/200 |
| 5,064,739 | 11/1991 | Asanae et al. | 430/122 |
| 5,119,758 | 6/1992 | Inoue et al. . | |
| 5,148,223 | 9/1992 | Cipolla . | |
| 5,202,728 | 4/1993 | Maeshima et al. | 355/245 |
| 5,250,987 | 10/1993 | Gern . | |

OTHER PUBLICATIONS

"Understanding Toner Cartridge Technology", *Recharger,* May 1992.

*Primary Examiner*—R. L. Moses

*Attorney, Agent, or Firm*—Thorpe, North & Western

[57] ABSTRACT

A method for increasing the page yield and transfer rate of a supply of toner material in a toner cartridge wherein an elongate, toner-dispensing gap in the toner cartridge is narrowed to within a range of approximately 0.002 inches to 0.004 inches, to thereby reduce the rate that the toner material is released in the printing process. Further enhancement occurs when the electrostatic charge density on a surface of a developer cylinder in the cartridge is reduced to a lowest setting. A drum in the cartridge may be replaced with a high performance organic photoconductor drum, and toner in the cartridge may be replaced with a fine granule, high quality toner having a granule size within a range of approximately 10.0 to 10.5 micrometers to further improve efficiency of toner transfer. This toner cartridge is then placed in a compatible laser printer for operation.

24 Claims, 1 Drawing Sheet

APPARATUS AND METHOD FOR METERING TONER IN LASER PRINTERS

BACKGROUND OF THE INVENTION

1. The Field of the Invention

The present invention relates generally to toner cartridges. More particularly, it concerns a method for increasing the printed page output and regulating the transfer rate of a certain amount of toner material in a toner cartridge as part of a printing process.

2. The Background Art.

Laser printers are known in the field of computer technology for reproducing the images of a computer screen as high quality printed images on a piece of paper. Electrostatic charge patterns corresponding to the images on the screen are produced on a rotational drum. These charge patterns are exposed to a magnetic roller coated with oppositely-charged toner particles. The toner particles are attracted from the roller to the charge patterns on the drum. The toner is thereby arranged in the image of the charge patterns, which correspond to the images on the computer screen. The toner on the drum is exposed to a piece of paper passing below the drum. A corona wire lies below the paper and carries the same charge as the charge patterns but at a much higher charge concentration. The toner particles are attracted to the corona wire and fall from the drum onto the paper in the arrangement of the charge patterns.

At this point, the toner sits loosely on the paper surface in an arrangement corresponding to the images on the computer screen. The paper is passed between upper and lower fusing rollers, the upper fusing roller being heated from within to a high temperature. The fusing rollers are pressed together as the paper passes therebetween, melting the toner particles and squeezing the melted toner into the fibers of the paper. The paper carrying the fused image exits the machine.

Toner material is typically made from ground particles of lead graphite. Toner is expensive and poses environmental concerns such as groundwater contamination, leaching of the soil, and so forth. It is therefore desirable to use toner in an efficient, productive manner and avoid toner waste which becomes released into the environment. However, the mechanics of extracting the toner from a toner supply and delivering it to a piece of paper involve many steps and machine parts, and necessarily cause toner waste which results in a reduced page yield and a less than perfect toner transfer rate. The term "page yield" as used herein refers to the average number of printed pages produced from a certain quantity of toner, typically one gram. The term "toner transfer rate" as used herein refers to the percentage of the toner which actually reaches the paper and gets used. Stray toner which is left on the drum surface is wiped off of the drum and delivered to a waste hopper. Hence, if seventy percent of the toner reaches the paper, then roughly thirty percent reaches the waste hopper and the toner transfer rate is seventy percent.

Of current interest are apparatus and methods for increasing the page yield and the toner transfer rate in a toner cartridge. It is known in the field to produce disposable/rechargeable toner cartridges having a self contained toner supply hopper, magnetic roller, drum, corona wire, and waste hopper. The toner cartridge is placed into a laser printer adjacent to fusing rollers therein to cooperate with the printer to carry out the printing functions described above. When the toner in the cartridge is used up, the cartridge is removed and either discarded or recharged.

Many attempts have been made to produce a toner cartridge which maximizes both the page yield and the toner transfer rate. However, the developers of the prior art toner cartridges have been unable to identify all of the key variables involved. The prior art toner cartridges have a number of disadvantages, and the developers thereof have generally attempted but failed to optimize the page yield and toner transfer rate. The page yield per gram of toner remains low, and the amount of toner waste delivered to the waste hopper remains high. The cost to end users is thus increased, and the negative effect on the environment of the wasted toner is multiplied.

OBJECTS AND SUMMARY OF THE INVENTION

It is therefore an object of the present invention to provide a method of dispensing toner from a toner cartridge as part of a printing process which increases the page yield per gram of toner.

It is an additional object of the invention to provide such a method of dispensing toner which increases the toner transfer rate and thereby decreases the amount of wasted toner and the resulting environmental risk.

It is another object of the invention to provide such a method of dispensing toner which is less expensive for the end user.

The above objects and others not specifically recited are realized in a method for increasing the page yield and transfer rate of a supply of toner in a toner cartridge. A toner cartridge is selected. An elongate, toner-dispensing gap of the toner cartridge is narrowed to within a range of approximately 0.002 inches to 0.004 inches, to thereby reduce the rate that the toner material is released in the printing process. A drum in the cartridge is replaced with a high performance organic photoconductor drum, and the toner is replaced with a fine granule, high quality toner having a granule size within a range of approximately 10.0 to 10.5 micrometers (0.000394 inches to 0.000413 inches). The toner cartridge is placed in a compatible laser printer. The laser printer is operated to thereby cause the toner to be dispensed from the gap and eventually transferred onto a page, resulting in a high page yield and toner transfer rate.

Additional objects and advantages of the invention will be set forth in the description Which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawing in which.

DETAILED DESCRIPTION OF PRESENTLY PREFERRED EMBODIMENTS

Figure 1:
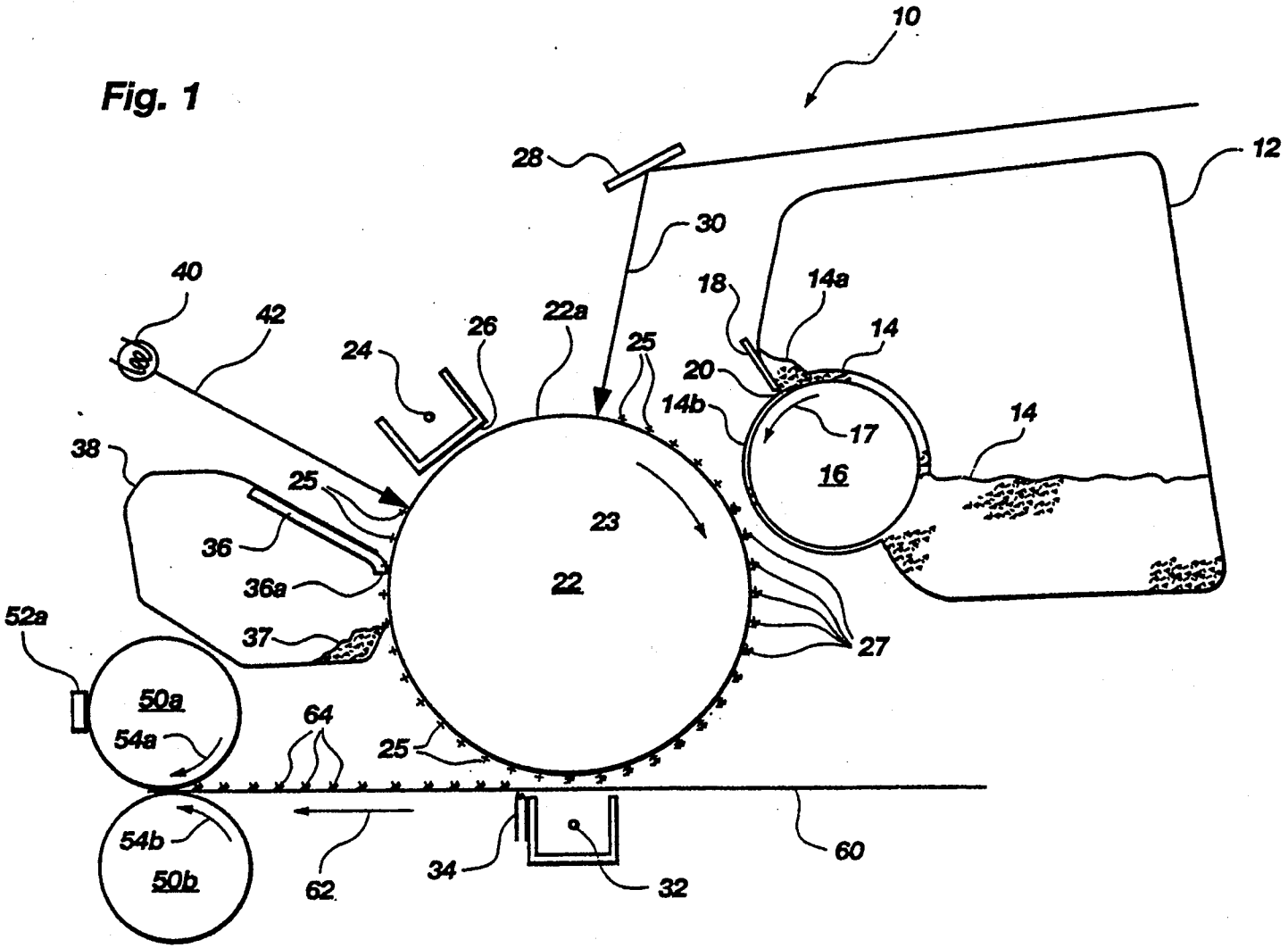
FIG. 1 illustrates a side, schematic view of apparatus in accordance with the principles of the present invention.

Reference will now be made to the drawings wherein like structures will be provided with like reference numerals.

FIG. 1 illustrates the features of a developing apparatus, generally designated at 10, of a toner cartridge. The developing apparatus 10 is shown in a side, schematic view, and includes a toner hopper 12 containing a supply of fresh toner particles 14. Rotatably disposed on the hopper 12 in substantially parallel orientation are an elongate, developer cylinder 16 (known as a magnetic roller, or "mag" roller) and an elongate leveling blade 18 which cooperatively define an elongate, toner dispensing gap 20 therebetween.

A rotational drum 22 is disposed adjacent and substantially parallel to the cylinder 16. An elongate, primary corona wire 24 is positioned adjacent and substantially parallel to the drum 22, and a primary grid 26 resides therebetween. A mirror 28 is positioned to direct a laser beam 30 onto a certain portion of the drum 22. A transfer corona wire 32 is disposed below the drum 22, as is a static discharge member 34. A cleaning blade 36 includes a contact edge **36*a* positioned against the roller 22. The cleaning blade 36 is mounted within a waste hopper 38 containing toner waste 37. An erase lamp 40 produces an erase light beam 42 and directs said beam 42 onto a certain portion of the drum 22. A pair of elongate, substantially parallel fusing rollers 50*a* and 50*b* are shown on opposing sides of an imaginary plane passing below the drum 22. Biased against the upper fusing roller 50*a* is a fuser wand 52** in substantially parallel contact therewith.

The purpose and interrelationship of the elements identified above will be discussed in more detail below, in reference to FIG. 1. Before describing the details of our discovery, we would like to provide the following relevant background information.

The primary corona wire 24 is a fine wire which carries a high voltage potential, typically about −6000 volts. The charge which produces such a high voltage potential causes a corona of ionized air to form around the wire 24 along its length. Although air is normally a good insulator of electrical current, the ionized air corona around the wire 24 allows electrical current to transfer from the wire 24 to reach and charge the drum surface **22*a* without contact with the drum. The primary corona wire 24 charges the drum surface 22*a* to a voltage potential of approximately −600 volts. The primary grid 26 acts as an electrical charge regulator, evening out the charge across the drum surface 22*a* and bleeding off excess charge from the primary corona 24**.

A laser unit (not shown) emits laser beam pulses 30 onto the mirror 28, which reflects the pulses 30 onto the drum. The laser light 30 is produced such that when it strikes the negatively charged drum surface **22*a*, it neutralizes the negative charge produced by the primary corona wire 24, and leaves lines of electrostatic charge patterns 25. The charge patterns 25 are discharges of approximately 100 volts, relatively positive. These patterns 25 are selectively formulated, and typically resemble images shown on a computer screen (not shown). The drum 22 is caused to rotate about its longitudinal axis toward the developer cylinder 16 in the direction of arrow 23**.

The toner hopper 12 holds fresh toner particles 14. The developer cylinder 16 is housed in a lower portion of the hopper 12 as shown, and operates to dispense the toner 14 from the gap 20. The cylinder 16 has a strong magnet inside (not shown) and rotates toward the drum 22 in the direction of arrow 17 as shown. The magnetic force produced by the magnet within the cylinder 16 attracts the toner particles 14 to the cylinder 16. As the cylinder 16 rotates, the magnetically attracted toner 14 builds up on the cylinder 16 behind the leveling blade 18 (sometimes referred to as a doctor blade) at **14*a*. The leveling blade 18 is precision ground and spaced away from the cylinder 16 to form the gap 20 which permits only a thin layer of toner 14*b* to be released from the hopper 12. The rotational movement of the cylinder 16 causes the toner particles at 14*a* behind the leveling blade 18 to rub against each other in an effort to get through the gap 20. This frictional contact produces a negative charge build-up on the toner particles 14**.

The toner layer **14*b* thus carries a negative charge, and is held on the rotational cylinder 16 by the magnetic force described above. However, the surface of the cylinder 16 is also negatively charged to a voltage potential of approximately −600 volts, sometimes referred to as a bias voltage, causing the cylinder 16 to repel the toner 14. There is thus a "push and pull" effect produced by the magnetic force attracting the toner, and by the negative electrostatic charge repelling the toner, the net effect being that the toner remains on the cylinder 16 until it rolls close to the drum 22**.

Since the drum surface **22*a* also carries a negative charge, it also tends to repel the toner particles. However, the charge patterns 25 carry a relatively positive charge. The negative, repelling force of the surface of the cylinder 16 and the positive charge of the patterns 25 co-act to cause toner particles 14 to be attracted from the cylinder 16 exactly onto the patterns 25, as represented at 27. The repelling action of the negative charge on the drum surface 22*a* substantially prevents toner particles from landing anywhere on the drum surface 22*a* except on the charge patterns 25**.

The transfer corona 32 operates much like the primary corona wire 24 as discussed above, except that it carries a positive charge at a voltage potential of about +6000 volts. The transfer corona wire 32 produces a current path beneath a sheet of paper 60 having a voltage potential of approximately +600 volts as said paper passes between the transfer corona wire 32 and the drum 22 in the direction shown at arrow 62. This is sufficient to attract toner particles from the toner-laden charge patterns 27 onto the paper 60 at toner patterns 64, such that said toner patterns retain the configuration of the charge patterns 25, and hence the images of the computer screen.

The toner still carries a negative charge after it has fallen from the drum 22 onto the paper 60 into the toner patterns 64. The static discharge member 34 operates to neutralize the negative charge of the toner patterns 64 as the paper moves past said discharge member in the direction of arrow 62. This helps prevent the toner particles from repelling each other or becoming otherwise rearranged as a result of their negative charge.

The paper passes between the opposing fusing rollers 50a and 50b. The upper fusing roller **50*a* is heated from within, and the lower fusing roller 50*b* typically comprises a spongy, rubber roller. As the rollers 50*a* and 50*b* rotate in opposing directions 54*a* and 54*b*, respectively, the lower roller 50*b* operates to press the paper 60 upward against the heated upper roller 50*a*. The upper roller 50*a* thereby melts the toner patterns 64, and the lower roller 50***b* squeezes the melted toner patterns into the fibers of the paper 60 to produce a high resolution printed resemblance of the images on a computer screen. The paper 60 exits the printer, and the fuser wand 52 cleans any stray toner particles from the fusing roller 50*a*.

An aspect of the print quality is the density of the character patterns produced on the paper 60, often referred to as the "print density". Denser printed characters are generally bolder and easier to read. Laser printers typically offer a range of control settings (not shown) for controlling the print density of the printed characters. The control settings are selectable in a number of ways, depending on the laser printer. Most laser printers typically have the control settings manually selectable by a control knob, or by digital input commands. A typical range of settings includes nine print density settings numbered 1 to 9. The function of the control settings is to reduce or increase the negative charge density on the surface of the developer cylinder 16. The higher the charge density is on the surface of the cylinder 16, the more toner is attracted onto the charge patterns 25 and the denser the printed output is. Generally, the lowest print density setting of "1" corresponds to a highest charge density on the surface of the cylinder 16 and thus the darkest print output, while the highest print density setting of "9" corresponds to a lowest charge density.

As the drum 22 rotates beyond the developing components described above, the contact edge 36*a* of the cleaning blade 36 physically wipes any stray toner particles from the drum 22, which fall into the waste hopper 38. As the drum 22 rotates beyond the cleaning components, the erase light beam 42 produced by the erase lamp 40 uniformly discharges the leftover charge patterns 25 on the drum 22 just before the drum 22 receives a fresh electrical charge from the primary corona 24. The image formation process is continuous, and the events described above occur at the same time.

An aspect of the present invention is to alter the features of a toner cartridge relative to their prior art configuration to substantially increase the page yield and toner transfer rate from previously known levels. Applicants have discovered that the page yield and toner transfer rate are a function of many different variables, including the charge density on the toner 14, the thickness of the toner coating 14*b* on the cylinder 16, the charge density on the cylinder 16, the density of the charge patterns 25 on the drum 22, the granule size and composition of the toner 14, the width of the gap 20, the quality of the drum 22 and the ability of the drum surface 22*a* to carry a charge. However, the previous attempts to improve the page yield and toner transfer rate indicate the uncertainty in the field as to which are the key variables, and what combination of variables produces optimal results.

The conventional wisdom in the field of toner cartridges is fraught with contradictions, especially regarding page yield and toner transfer rate. One school of thought teaches that page yield, toner transfer rate, and print quality are not functions of the width of the gap 20; i.e. as long as the toner particles 14 can get through the gap 20, these aspects remain generally the same. See Don Thompson, "Understanding Toner Cartridge Technology", Recharger, May 1992 at 103. Other schools of thought teach that in order to maintain a given print quality, a decrease in the cylinder charge density must be accompanied by a corresponding increase of the gap 20; conversely, the narrower the gap 20 is, the higher the cylinder charge density must be. The thinking is that the smaller the toner coating 14*b* is, the higher the cylinder charge density must be in order to repel enough of the smaller amount of toner onto the drum 22.

Consequently, the prior art teaches that the gap 20 should be set to a width within a range of 100μ and 500μ (0.004 inches to 0.02 inches), and preferably at about 240μ (0.009 inches) (see U.S. Pat. No. 4,373,468, issued on Feb. 14, 1983 to Suda et al. at col. 4, lines 30–34). Other prior art references teach an even wider exemplary gap width of 0.3 mm (0.012 inches) (see U.S. Pat. No. 4,597,661, issued on Jul. 1, 1986 to Yamashita at col. 5, lines 16–18). The prior art teaches that these factory settings ". . . should be maintained for best cartridge performance." Thompson, "Understanding Toner Cartridge Technology", at 103. Applicants note that the symbol "μ" refers to micrometers, or $1\times10^{-6}$ meters.

However, applicants have discovered the surprising result that when the gap 20 is narrowed to a width within a range of about 0.002 inches to 0.004 inches, the toner from the toner-laden charge patterns 27 is more effectively transferred from the drum 22 onto the paper 60. Consequently, this allows for a lower cylinder charge density to produce a given print quality. Advantages which follow from this surprising discovery include that the toner transfer rate is drastically increased, as is the page yield per gram of toner. The advantages are optimized when a fine-granular, high-grade toner and a high quality organic photoconductor (OPC) drum are used.

Applicants have also discovered that the increased effectiveness of toner transfer brought about by narrowing the gap 20 results in a lower charge density requirement on the surface of the cylinder 16 to achieve a given print density. This appears to be contrary to the conventional wisdom discussed above, which teaches the quite different concepts that the width of the gap 20 either has no effect on toner transfer and page yield, or that a decrease in the width of the gap 20 requires an increase in the charge density on the cylinder 16 to maintain a given print density.

Possible reasons for these surprising results include that narrowing the gap 20 somehow increases, instead of decreases, the charge held by the toner 14. Perhaps because the toner charge is higher, or for some other reason not known to applicant, the toner is more easily attracted from the cylinder 16 onto the drum 22, and from the drum 22 onto the paper 60, leaving less stray toner on the drum 22 and thereby increasing the page yield and reducing the amount of toner waste 37. The direct cost savings which follow from this novel approach include the reduced cost per page resulting from the increase in page yield and toner transfer rate. Secondary cost savings include a longer life of the fuser wand 52, which must be periodically replaced after is has absorbed a certain amount of stray toner. Since less stray toner is left on the drum surface 22*a* with applicants' method, the fuser wand 52 need not be replaced as often.

EXAMPLE

The invention preferably involves the following components and method steps, which produced an excellent page yield and toner transfer rate:

(1) selecting a GSX toner cartridge made by the Green Cartridge Co.;
(2) replacing the drum in the cartridge with an Evergreen drum made by the Accutone Co.;
(3) replacing the toner particles in the cartridge with SX Graphics Toner made by the Accutone Co., having a granule size within a range of approximately 8.5μ to 12.0μ, and preferably within a range of approximately 10μ to 10.5μ (0.00039 inches to 0.00041 inches);
(4) repositioning the leveling blade in the cartridge to produce a gap width of approximately 0.003 inches between the leveling blade and the roller;
(5) placing the toner cartridge in a compatible laser printer;
(6) selecting a print density setting corresponding to a lowest charge density on the surface of the developer cylinder;
(7) operating the laser printer to thereby cause the toner to be dispensed from the gap and eventually transferred onto a page member.

This particular combination of features and specifications results in a print quality and print density which meets or exceeds that obtained with the unaltered, prior art toner cartridge. However, the unaltered cartridge comes with a factory-set gap width within a range of approximately 0.007 inches to 0.012 inches. As noted above, the prior art teaches that such factory settings "should be maintained for best cartridge performance." Thompson, "Understanding Toner Cartridge Technology" at 103. Applicants' alteration of the factory settings, particularly narrowing the gap width in conjunction with lowering the cylinder charge density setting in contravention of the conventional wisdom, results in a surprisingly high page yield and transfer rate while maintaining optimal print quality.

The surprising results asserted above and others not specifically mentioned, have not only been discovered by the applicants, they have also been verified in experimental, independent testing conducted by Buyers Laboratory, Inc. of Hackensack, N.J. The experimental testing was directed to performance testing of an embodiment of applicants' invention and a leading prior art toner cartridge, and comparative analysis of the two cartridges. The prior art toner cartridge was manufactured by the OEM company. The testing of both cartridges was confined to common control criteria, including printed page coverage of 8.05 percent in Courier 10 pitch characters. The results of the testing include the following:

Applicants' Cartridge Results:
Print density setting: "9."
Average full cartridge weight: 1,630.05 grams
Average exhausted cartridge weight: 1,200.55 grams
Average empty weight: 1,129.85 grams
Average page yield: 5,631.00 pages per cartridge 11.26 pages per gram of toner
Data derived from the results of applicants' cartridge:
Average toner supply: 500.20 grams (1,630.05–1,129.85)
Average toner used: 429.50 grams (1,630.05–1,200.55)
Average toner wasted: 70.70 grams (500.20–429.50)
Average toner transfer rate: 85.9% (429.5÷500.2×100%)
OEM Cartridge Results:
Print density setting: "5."
Average full cartridge weight: 1,316.90 grams
Average exhausted cartridge weight: 1,103.20 grams
Average empty weight: 1,036.40 grams
Average page yield: 1,876.00 pages per cartridge 6.69 pages per gram of toner
Data derived from the results of the OEM cartridge:
Average toner supply: 280.50 grams (1,316.90–1,036.40)
Average toner used: 213.70 grams (1,316.90–1,103.20)
Average toner wasted: 66.80 grams (280.50–213.70)
Average toner transfer rate: 76.2% (213.7÷280.5×100%)

The printed output for each cartridge had a printed page coverage of 8.05 percent in Courier 10 pitch characters, as noted above. Further, the print density of the printed characters for both cartridges averaged 1.360 on a scale of 0 to 2.5, with 2.5 being as dark as would be possible under most circumstances. It is noted that applicants' print density setting of "9" corresponds to the lowest charge density on the developer cylinder 16, whereas the OEM print density setting of "5" corresponds to a moderate charge density on the developer cylinder 16. Put another way, applicants' cartridge achieved equivalent print density with a lower charge density on the developer cylinder 16. Applicants further note that the equivalent print density was not only achieved with a lower charge density on the cylinder 16, but with a narrow width of gap 20 equal to approximately 0.003 inches. This is in contravention to the conventional wisdom as discussed above, which promotes unaltered gap widths between 0.007 inches to 0.012 inches, or an increase in cylinder charge density with a decrease in gap width.

As seen from the above results of the independent experimental testing, an embodiment of the present invention produced surprising results in comparison to the results produced by the leading toner cartridge from the OEM company. Applicants' page yield of 11.26 pages per gram of toner far surpasses the OEM cartridge page yield of 6.69 pages per gram of toner. This illustrates the potential for drastically reduced printing costs for users of applicants' invention. Applicants' toner transfer rate of 85.9% surpasses by almost ten percent the OEM cartridge toner transfer rate of 76.2%. Put another way, while about 24 grams of toner is wasted per 100 grams by the OEM cartridge, only about 14 grams of toner is wasted per 100 grams by applicants' invention. This means that the prior art OEM cartridge wastes toner at a rate of about 71% higher (24−14=10; 10÷14×100%=71%) than that of applicants' invention. Therefore, toner cartridges made in accordance with applicants' invention pose a much lower threat to the environment by reducing the amount of toner released into the environment. Toner waste is something that should not be placed in landfills, but must be disposed of by environmentally risk averse methods. The present invention reduces the volume of toner waste and the resulting costs required for proper disposal thereof.

The testing report from Buyers Laboratory, Inc. noted that applicants' cartridge page yield of 5,631.00 is the highest page yield to date in its testing program. The report also noted that applicants' cartridge is a quality unit that meets or exceeds the performance of the OEM cartridge.

There are many possible configurations of the invention, and many additional environments in which the invention can be used. For example, the developing apparatus in any developing device involving toner can be improved with the present invention, such as that found in electrophotographic copying machines. The principles of the invention may thus be used in any setting requiring the advantages thereof. Those having ordinary skill in the field of this invention will appreciate the advantages of the invention, and its application to a wide variety of uses.

The present invention represents a significant advance in the field of toner cartridges. It is noted that many of the advantages of the present invention accrue due to the reduction of the gap 20 and a corresponding decrease in charge density on the surface of the developer cylinder 16, in contravention to the conventional wisdom. The problems noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A process for developing electrostatic images by a developing apparatus comprising a toner hopper having an opening therein, a magnetic cylinder having an exterior surface and being rotatably disposed at the opening of the toner hopper such that a first portion of said exterior surface resides within the hopper and a second portion thereof is exposed outside of the hopper, and a drum having an electrically charged photoconductive exterior surface rotatably disposed in parallel orientation with and facing the exposed second portion of the magnetic cylinder, said process comprising the steps of:

(a) affixing a leveling member to the hopper at the opening thereof such that the magnetic cylinder and the leveling member cooperatively define an elongate toner-dispensing gap therebetween in communication with the hopper and having a width within a range of approximately 0.002 inches to 0.004 inches;

(b) inserting toner particles into the hopper;

(c) rotating the magnetic cylinder in a first rotational direction to thereby draw toner particles out of the hopper through the toner-dispensing gap such that said toner particles reside exposed upon the exposed exterior surface of the magnetic cylinder;

(d) producing electrostatic images on the photoconductive exterior surface of the drum;

(e) rotating the drum in a second rotational direction opposite the first rotational direction of the magnetic cylinder to thereby cause at least some of the exposed toner particles to be attracted from the magnetic cylinder onto the electrostatic images;

(f) advancing a page member past the drum and attracting at least some of the toner particles from the electrostatic images onto the page member in the form of said electrostatic images, and fusing said toner particles onto the page member;

(g) producing an electric charge biasing voltage upon the exterior surface of the magnetic cylinder to create a charge density sufficient to produce an average page yield of at least approximately seven pages per gram of toner particles, said page yield being based upon a printed page coverage of at least approximately 8 percent on 8½ inch by 11 inch page members and at a print density of at least approximately 1.360 on a scale of 0 to 2.5, with 2.5 being maximum darkness.

2. A process as defined in claim 1, wherein step (g) further comprises producing the biasing voltage to create a charge density sufficient to achieve an average toner transfer rate (percentage of toner particles used and not wasted) of at least approximately 78 percent.

3. A process as defined in claim 1, wherein step (g) further comprises producing the biasing voltage to create a charge density sufficient to achieve an average toner transfer rate (percentage of toner particles used and not wasted) of at least approximately 82 percent.

4. A process as defined in claim 1, wherein step (g) further comprises producing the biasing voltage to create a charge density sufficient to achieve an average toner transfer rate (percentage of toner particles used and not wasted) of at least approximately 85 percent.

5. A process as defined in claim 1, wherein step (g) further comprises producing the biasing voltage on the magnetic cylinder to create a charge density sufficient to achieve a page yield of at least approximately nine pages per gram of toner particles.

6. A process as defined in claim 1, wherein step (g) further comprises producing the biasing voltage on the magnetic cylinder to create a charge density sufficient to achieve a page yield of at least approximately eleven pages per gram of toner particles.

7. A process as defined in claim 1, wherein step (a) further comprises affixing the leveling member so as to define the toner-dispensing gap to have a width of approximately 0.003 inches.

8. A process as defined in claim 1, wherein step (b) further comprises inserting toner particles having a particle size within a range of approximately 8.5$\mu$ to 12.0$\mu$.

9. A process for developing electrostatic images by a developing apparatus comprising a toner hopper having an opening therein, a magnetic cylinder having an exterior surface and being rotatably disposed at the opening of the toner hopper such that a first portion of said exterior surface resides within the hopper and a second portion thereof is exposed outside of the hopper, and a drum having an electrically charged photoconductive exterior surface rotatably disposed in parallel orientation with and facing the exposed second portion of the magnetic cylinder, said process comprising the steps of:

(a) affixing a leveling member to the hopper at the opening thereof such that the magnetic cylinder and the leveling member cooperatively define an elongate toner-dispensing gap therebetween in communication with the hopper and having a width within a range of approximately 0.002 inches to 0.004 inches;

(b) inserting toner particles into the hopper;

(c) rotating the magnetic cylinder in a first rotational direction to thereby draw toner particles out of the hopper through the toner-dispensing gap such that said toner particles reside exposed upon the exposed exterior surface of the magnetic cylinder;

(d) producing electrostatic images on the photoconductive exterior surface of the drum;

(e) rotating the drum in a second rotational direction opposite the first rotational direction of the magnetic cylinder to thereby cause at least some of the exposed toner particles to be attracted from the magnetic cylinder onto the electrostatic images;

(f) advancing a page member past the drum and attracting at least some of the toner particles from the electrostatic images onto the page member in the form of said electrostatic images, and fusing said toner particles onto the page member;

(g) producing an electric charge biasing voltage upon the exterior surface of the magnetic cylinder to create a charge density sufficient to achieve an average toner transfer rate (percentage of toner particles used and not wasted) of at least approximately 78 percent.

10. A process as defined in claim 9, wherein step (g) further comprises producing the biasing voltage to create a charge density sufficient to achieve an average toner transfer rate (percentage of toner particles used and not wasted) of at least approximately 82 percent.

11. A process as defined in claim 9, wherein step (g) further comprises producing the biasing voltage to create a charge density sufficient to achieve an average toner transfer rate (percentage of toner particles used and not wasted) of at least approximately 85 percent.

12. A process as defined in claim 9, wherein step (g) further comprises producing the biasing voltage to create a charge density sufficient to produce an average page yield of at least approximately seven pages per gram of toner particles, said page yield being based upon a printed page coverage of at least approximately 8 percent on 8½ inch by 11 inch page members and at a print density of at least approximately 1.360 on a scale of 0 to 2.5, with 2.5 being maximum darkness.

13. A process as defined in claim 9, wherein step (g) further comprises producing the charge density of the biasing voltage on the magnetic cylinder sufficient to achieve an average page yield of at least approximately nine pages per gram of toner particles.

14. A process as defined in claim 9, wherein step (g) further comprises producing the charge density of the biasing voltage on the magnetic cylinder sufficient to achieve an average page yield of at least approximately eleven pages per gram of toner particles.

15. A process as defined in claim 9, wherein step (a) further comprises setting the leveling member so as to define the toner-dispensing gap to have a width of approximately 0.003 inches.

16. A process as defined in claim 9, wherein step (b) further comprises inserting toner particles having a particle size within a range of approximately 8.5$\mu$ to 12.0$\mu$.

17. A developing apparatus for developing electrostatic images, said apparatus comprising:

a toner hopper having an opening therein;

a magnetic cylinder having an exterior surface and being rotatably disposed at the opening of the toner hopper such that a first portion of said exterior surface resides within the hopper and a second portion thereof is exposed outside of the hopper;

a drum having an electrically charged photoconductive exterior surface rotatably disposed in parallel orientation with and facing the exposed second portion of the magnetic cylinder;

a leveling member affixed to the hopper at the opening thereof such that the magnetic cylinder and the leveling member cooperatively define an elongate toner-dispensing gap therebetween in communication with the hopper and having a width within a range of approximately 0.002 inches to 0.004 inches;

toner particles residing in the hopper;

means for rotating the magnetic cylinder in a first rotational direction to thereby draw toner particles out of the hopper through the toner-dispensing gap such that said toner particles reside exposed upon the exposed exterior surface of the magnetic cylinder;

means for producing electrostatic images on the photoconductive exterior surface of the drum;

means for rotating the drum in a second rotational direction opposite the first rotational direction of the magnetic cylinder to thereby cause at least some of the exposed toner particles to be attracted from the magnetic cylinder onto the electrostatic images;

means for advancing a page member past the drum and attracting at least some of the toner particles from the electrostatic images onto the page member in the form of said electrostatic images, including means for fusing said toner particles onto the page member; and means for producing an electric charge biasing voltage upon the exterior surface of the magnetic cylinder to create a charge density sufficient to produce an average page yield of at least approximately seven pages per gram of toner particles, said page yield being based upon a printed page coverage of at least approximately 8 percent on 8½ inch by 11 inch page members and at a print density of at least approximately 1.360 on a scale of 0 to 2.5, with 2.5 being maximum darkness.

18. A developing apparatus as defined in claim 17, wherein the means for producing the biasing voltage is operative to produce a charge density sufficient to achieve an average toner transfer rate (percentage of toner particles used and not wasted) of at least approximately 78 percent.

19. A developing apparatus as defined in claim 17, wherein the means for producing the biasing voltage is operative to produce a charge density sufficient to achieve an average toner transfer rate (percentage of toner particles used and not wasted) of at least approximately 82 percent.

20. A developing apparatus as defined in claim 17, wherein the means for producing the biasing voltage is operative to produce a charge density sufficient to achieve an average toner transfer rate (percentage of toner particles used and not wasted) of at least approximately 85 percent.

21. A developing apparatus as defined in claim 17, wherein the means for producing the biasing voltage is operative to produce a charge density on the magnetic cylinder sufficient to achieve a page yield of at least approximately nine pages per gram of toner particles.

22. A developing apparatus as defined in claim 17, wherein the means for producing the biasing voltage is operative to produce a charge density on the magnetic cylinder sufficient to achieve a page yield of at least approximately eleven pages per gram of toner particles.

23. A developing apparatus as defined in claim 17, wherein the toner particles have a particle size within a range of approximately 8.5$\mu$ to 12$\mu$.

24. A developing apparatus for developing electrostatic images, said apparatus comprising:

a toner hopper having an opening therein;

a magnetic cylinder having an exterior surface and being rotatably disposed at the opening of the toner hopper such that a first portion of said exterior surface resides within the hopper and a second portion thereof is exposed outside of the hopper;

a drum having an electrically charged photoconductive exterior surface rotatably disposed in parallel orientation with and facing the exposed second portion of the magnetic cylinder;

a leveling member affixed to the hopper at the opening thereof such that the magnetic cylinder and the leveling member cooperatively define an elongate toner-dispensing gap therebetween in communication with the hopper and having a width within a range of approximately 0.002 inches to 0.004 inches;

toner particles residing in the hopper;

means for rotating the magnetic cylinder in a first rotational direction to thereby draw toner particles out of the hopper through the toner-dispensing gap such that said toner particles reside exposed upon the exposed exterior surface of the magnetic cylinder;

means for producing electrostatic images on the photoconductive exterior surface of the drum;

means for rotating the drum in a second rotational direction opposite the first rotational direction of the magnetic cylinder to thereby cause at least some of the exposed toner particles to be attracted from the magnetic cylinder onto the electrostatic images;

means for advancing a page member past the drum and attracting at least some of the toner particles from the electrostatic images onto the page member in the form of said electrostatic images, including means for fusing said toner particles onto the page member; and means for producing an electric charge biasing voltage upon the exterior surface of the magnetic cylinder to a charge density sufficient to achieve an average toner transfer rate (percentage of toner particles used and not wasted) of at least approximately 78 percent.

* * * * *